US011519651B2

(12) United States Patent
Sigl et al.

(10) Patent No.: US 11,519,651 B2
(45) Date of Patent: Dec. 6, 2022

(54) ICE MAKER WITH SPECIFIC COOLING OF A STORAGE CONTAINER, AND HOUSEHOLD COOLING APPLIANCE

(71) Applicant: BSH HAUSGERAETE GMBH, Munich (DE)

(72) Inventors: Mathias Sigl, Herbrechtingen (DE); Jorge Carlos Montalvo Sanchez, Knoxville, TN (US); Julio Cesar Schmidt, Knoxville, TN (US); Marco Marques, Knoxville, TN (US)

(73) Assignee: BSH HAUSGERAETE GMBH, Munich (DE)

( * ) Notice: Subject to any disclaimer, the term of this patent is extended or adjusted under 35 U.S.C. 154(b) by 167 days.

(21) Appl. No.: 16/733,288

(22) Filed: Jan. 3, 2020

(65) Prior Publication Data

US 2021/0207864 A1 Jul. 8, 2021

(51) Int. Cl.

| | |
|---|---|
| ***F25C 5/182*** | (2018.01) |
| ***F25D 17/06*** | (2006.01) |
| ***F25C 1/00*** | (2006.01) |

(52) U.S. Cl.

CPC ..... *F25C 5/182* (2013.01); *F25C 1/00* (2013.01); *F25D 17/062* (2013.01); *F25C 2400/10* (2013.01); *F25D 2317/06* (2013.01)

(58) Field of Classification Search

CPC ..... F25D 2317/061; F25D 17/062; F25D 2317/06; F25C 1/00; F25C 2400/10; F25C 5/182

See application file for complete search history.

(56) References Cited

U.S. PATENT DOCUMENTS

| | | | | |
|---|---|---|---|---|
| 9,482,458 | B2 | 11/2016 | Jeong et al. | |
| 2008/0295539 | A1* | 12/2008 | An | F25D 17/065 62/407 |
| 2010/0180608 | A1* | 7/2010 | Shaha | F25D 23/04 62/66 |
| 2016/0370078 | A1* | 12/2016 | Koo | F25D 23/028 |
| 2018/0231294 | A1* | 8/2018 | Song | F25C 1/24 |
| 2019/0011166 | A1* | 1/2019 | Bertolini | F25C 5/22 |

* cited by examiner

*Primary Examiner* — Elizabeth J Martin

(74) *Attorney, Agent, or Firm* — Laurence A. Greenberg; Werner H. Stemer; Ralph E. Locher

(57) ABSTRACT

An ice maker for mounting into a household cooling appliance includes a storage container for ice that is formed with an opening which is accessible from the top. A fan generates an air stream in the ice maker. An air guiding duct above the storage container is bounded by a first lateral duct wall, which is oriented in the depth direction of the ice maker and extends in the height direction, and is bounded by a second duct wall, which is a roof wall. The air guiding duct has a first opening towards the bottom so that an air stream escapes towards the bottom. The first opening of the air guiding duct is arranged offset viewed in the width direction of the ice maker so that the air stream exiting from the first opening of the air guiding duct flows along an outer side of the storage container.

15 Claims, 11 Drawing Sheets

ICE MAKER WITH SPECIFIC COOLING OF A STORAGE CONTAINER, AND HOUSEHOLD COOLING APPLIANCE

BACKGROUND OF THE INVENTION

Field of the Invention

One aspect of the invention relates to an ice maker. A further aspect relates to a household cooling appliance.

U.S. Pat. No. 9,482,458 B2 describes an ice maker comprising an air guidance for guiding cold air. However, the air guidance is very undefined. Thereby also air can find its way into a storage container of the ice maker, in which ice form elements are stored. Thereby it is also possible that a corresponding air stream flows against or around the produced ice form elements in the storage container. The ice form elements due to sublimation release vapors. Since the air stream can also enter the storage container, by the air stream the distribution of these vapors is enforced, which however should be avoided.

BRIEF SUMMARY OF THE INVENTION

It is accordingly an object of the invention to provide an ice maker, which overcomes the above-mentioned and other disadvantages of the heretofore-known devices and methods of this general type and which provides for an ice maker, in which the entry of an air stream into a storage container of the ice maker is at least clearly reduced. It is a further object of the invention to provide a household cooling appliance with an ice maker in which the entering of an air stream into a storage container of the ice maker is at least significantly reduced.

With the above and other objects in view there is provided, in accordance with one aspect of the invention, an ice maker for mounting into a household cooling appliance, comprising:

a storage container for ice, wherein the storage container comprises an outer side and an opening, which is accessible from the top, a fan generating an air stream in the ice maker, an air guiding duct, which viewed in the height direction of the ice maker is arranged above the storage container, wherein the air guiding duct is bounded by a first lateral duct wall, which is oriented in the depth direction of the ice maker and extends in the height direction, and the air guiding duct is bounded by a second duct wall, which is a roof wall, wherein the air guiding duct with at least one first opening is open towards the bottom so that an air stream streaming in the air guiding duct can escape towards the bottom from the air guiding duct, wherein the first opening of the air guiding duct is arranged offset viewed in the width direction of the ice maker so that the air stream exiting from the first opening of the air guiding duct flows along the storage container on its outer side.

With the above and other objects in view there is also provided, in accordance with another aspect of the invention, a household cooling appliance comprising an ice maker, wherein the ice maker comprises:

a storage container for ice, wherein the storage container comprises an outer side and an opening, which is accessible from the top, a fan generating an air stream in the ice maker, an air guiding duct, which viewed in the height direction of the ice maker is arranged above the storage container, wherein the air guiding duct is bounded by a first lateral duct wall, which is oriented in the depth direction of the ice maker and extends in the height direction, and the air guiding duct is bounded by a second duct wall, which is a roof wall, wherein the air guiding duct with at least one first opening is open towards the bottom so that an air stream streaming in the air guiding duct can escape towards the bottom from the air guiding duct, wherein the first opening of the air guiding duct is arranged offset viewed in the width direction of the ice maker so that the air stream exiting from the first opening of the air guiding duct flows along the storage container on its outer side.

According to another aspect of the present disclosure, wherein by the air stream exiting from the opening of the air guiding duct an outer side of a first side wall of the storage container and an outer side of a bottom wall of the storage container and an outer side of a second side wall of the storage wall are flown, wherein said bottom wall is opposite to the opening of the storage container, which is accessible from the top.

According to another aspect of the present disclosure, wherein at least by the first lateral duct wall and the roof wall the air stream in the air guiding duct is guided in the depth direction of the ice maker.

According to another aspect of the present disclosure, the first lateral duct wall and the roof wall are configured as single-piece duct part.

According to another aspect of the present disclosure, the first lateral duct wall at least in portions is curved in arch-like manner.

According to another aspect of the present disclosure, the first lateral duct wall viewed in the depth direction in a rear half of its length is curved towards the interior of the ice maker.

According to another aspect of the present disclosure, the air guiding duct comprises a second lateral duct wall, which bounds the air guiding duct at the side opposite the first lateral duct wall.

According to another aspect of the present disclosure, the ice maker comprises an outer housing wall, which is the second lateral duct wall.

According to another aspect of the present disclosure, the roof wall comprises a contact flange, which directly contacts the second lateral duct wall.

According to another aspect of the present disclosure, the air guiding duct comprises a rear end and an opposite front end, and the air guiding duct is narrowed from the rear end towards the front end.

According to another aspect of the present disclosure, the ice maker comprises a driving unit, which comprises a housing and a fan arranged therein, wherein the air stream can be generated by the fan, the air guiding duct is connected with a rear end to the housing.

According to another aspect of the present disclosure, the air guiding duct is arranged at the driving unit by a stick connection.

According to another aspect of the present disclosure, the air guiding duct in the width direction of the ice maker is arranged to overlap in portions in an overlapping area with the opening of the storage container, wherein the air guiding duct comprises a bottom wall, by which the opening of the storage container is covered from the top in the overlapping area.

According to another aspect of the present disclosure, the first opening of the air guiding duct is formed in the bottom wall, and in the width direction is arranged external to the overlapping area.

According to another aspect of the present disclosure, said ice maker is arranged in a refrigeration compartment of a household cooling appliance.

Further features of the invention are apparent from the claims, the figures and the description of figures. The features and feature combinations mentioned above in the description as well as the features and feature combinations mentioned below in the description of figures and/or shown in the figures alone are usable not only in the respectively specified combination, but also in other combinations without departing from the scope of the invention. Thus, implementations are also to be considered as encompassed and disclosed by the invention, which are not explicitly shown in the figures and explained, but arise from and can be generated by separated feature combinations from the explained implementations. Implementations and feature combinations are also to be considered as disclosed, which thus do not comprise all of the features of an originally formulated independent claim. Moreover, implementations and feature combinations are to be considered as disclosed, in particular by the implementations set out above, which extend beyond or deviate from the feature combinations set out in the dependencies of the claims.

DETAILED DESCRIPTION OF PREFERRED EMBODIMENTS

In the figures, identical or functionally identical parts are provided with the same reference signs.

With indications of "top", "bottom", "front", "rear", "horizontal", "vertical", "depth direction", "width direction", "height direction", etc., the positions and orientations given in intended use and intended arrangement of the apparatus are specified.

Figure 1:
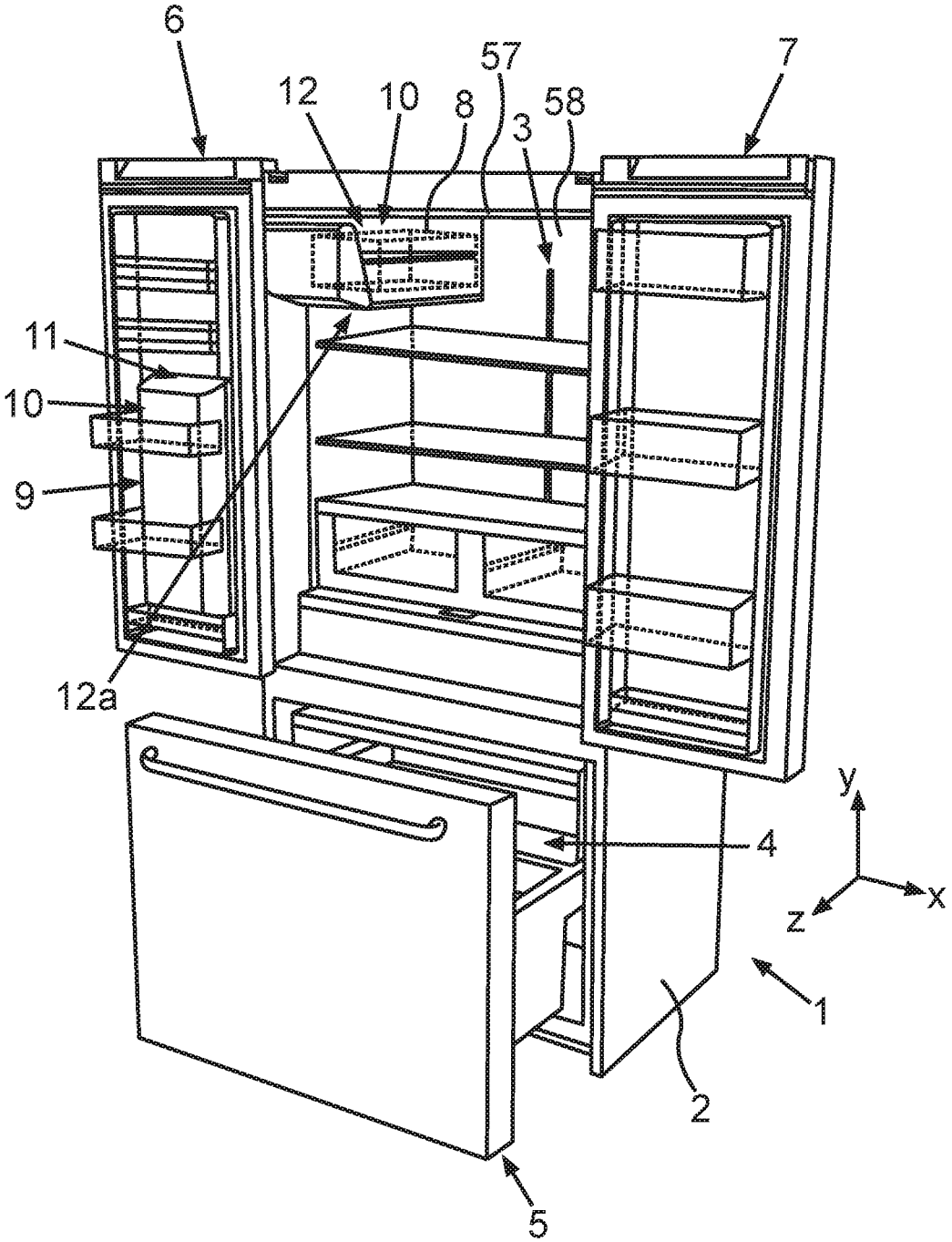
FIG. 1 is a perspective view of an embodiment of a household cooling appliance according to the invention.

Referring now to the figures of the drawing in detail and first, particularly, to FIG. 1 thereof, there is shown a perspective view of an embodiment of a household cooling appliance 1. The household cooling appliance 1 is configured for storing and preserving food items. In the shown embodiment the household cooling appliance 1 is a fridge freezer combination appliance. However, it can also be only a cooling or refrigeration appliance.

The illustrated household cooling appliance 1 comprises an outer housing 2. In the outer housing a first receiving space for food items is configured, which here is a refrigeration compartment 3. In an embodiment the household cooling appliance 1 moreover comprises a second receiving space for food items, which is separate from the first receiving space and which here is a freezer compartment 4. As can be recognized, in the embodiment shown here the refrigeration compartment 3 and the freezer compartment 4 are arranged one above the other in the height direction (y-direction) of the household cooling appliance 1. The freezer compartment 4, which is arranged further below, is capable of being locked by a door 5. The door 5 in the shown embodiment is a front wall of a drawer, which can be shifted linearly in the depth direction (z direction) of the household cooling appliance 1. The refrigeration compartment 3 is capable of being locked by two separate doors 6 and 7, which are shown in FIG. 1 in the opened state. The two separate doors 6 and 7 are capable of being pivoted about pivot axles, which are vertically oriented, and are arranged on the outer housing 2. The two doors 6 and 7 are arranged adjacent to each other in the width direction (x direction) and extend in the closed state in a front side plane. In particular also the door 5 in the closed stated extends in this plane, in which also the two doors 6 and 7 extend in the closed state.

In an embodiment the household cooling appliance 1 moreover comprises a dispenser 10 configured to output ice form elements or crushed ice. The dispenser 10 moreover can also optionally be configured to output a drink. In an embodiment the household cooling appliance 1 comprises a module 8. In an embodiment the dispenser 10 comprises said module 8.

The module 8 in the shown embodiment is arranged in the interior of the refrigeration compartment 3. This means that whilst the module 8 is arranged to be thermally insulated against the refrigeration compartment 3, however, that it is only accessible and reachable via the feed opening of the refrigeration compartment 3. Thus, the module 8 can only be made accessible, when at least the door 6 is opened.

The dispenser 10 in addition to the module 8 also comprises an output 9. The output 9 here is for instance configured to be integrally formed in the door 6. On an outer side of the door 6, which faces away from the refrigeration compartment 3 and then is also a front side, a niche is formed, in which a receiving container can be placed and in which then via the output 9 the ice form elements or the crushed ice can be output.

In the closed state of the door 6 the output 9 is coupled with the module 8 so that via an ice chute 11 formed here in the output 9 ice form elements or crushed ice can arrive at the output 9 from the module 8.

The module 8 can be an ice compartment 12*a*. The household cooling appliance 1 can then also be configured without an ice maker 12. The module 8 can also be an ice maker 12. The ice compartment 12*a* can be an integral part of the ice maker 12 if the household cooling appliance 1 comprises an ice maker 12.

In FIG. 1 an example for a household cooling appliance 1 comprising an ice maker 12 is schematically shown. The ice maker 12 is arranged in the refrigeration compartment 3. Viewed from the front side, it is arranged in a left top corner portion of the refrigeration compartment 3. The ice maker 12 is arranged to be thermally insulated from the remaining volume of the receiving space 3. The ice maker is only accessible, if the door 6 is opened.

Figure 2:
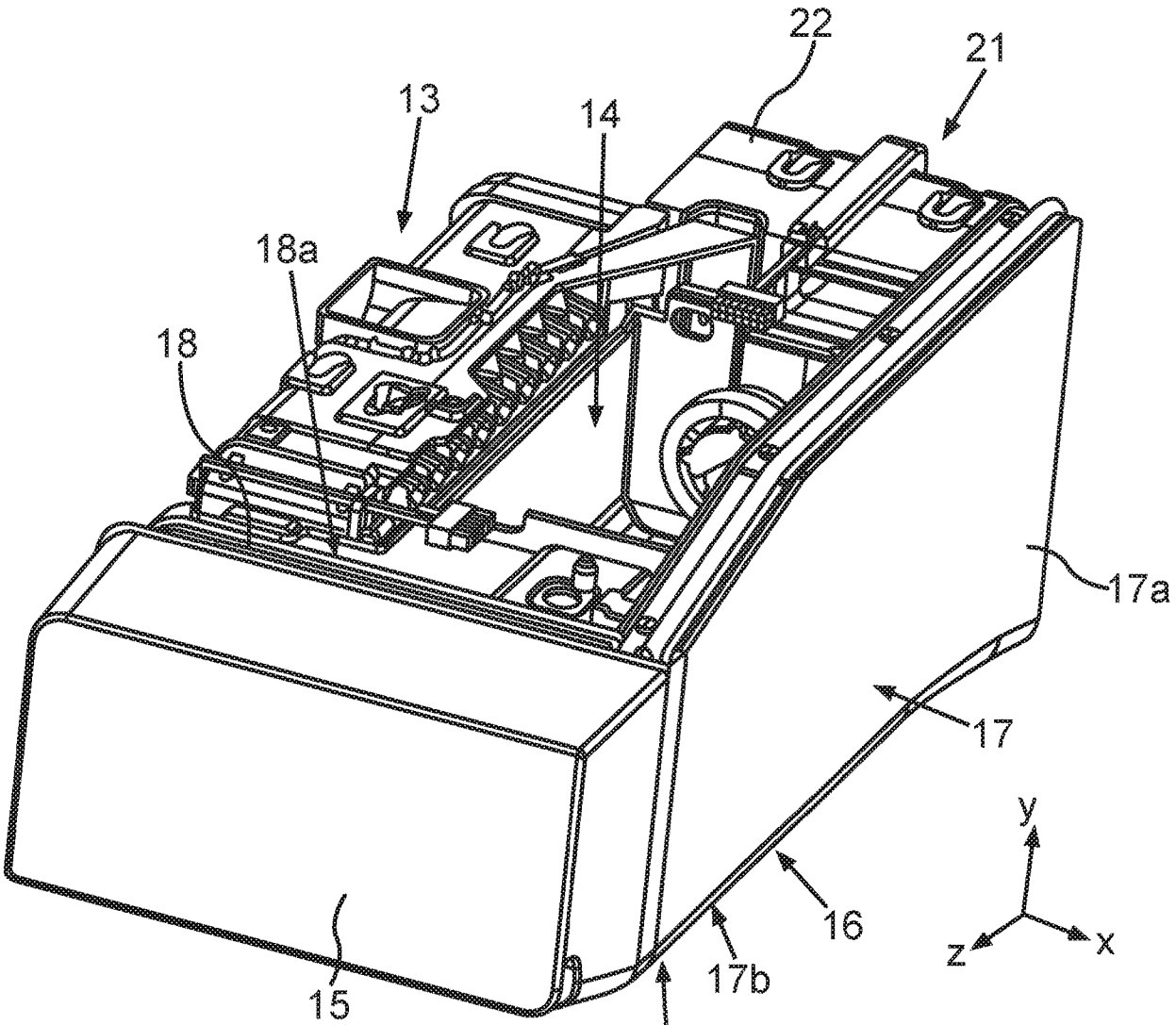
FIG. 2 is a perspective view of an embodiment of an ice maker according to the invention.

In FIG. 2 in a perspective view an embodiment of the ice maker 12 is shown. The ice maker 12 comprises an ice producer 13. Moreover, the ice maker 12 comprises a storage container 14. In the storage container 14 the ice form elements produced in the ice producer 13 can be stored. In FIG. 2 a conveyor 79 (FIG. 11) is not shown. The conveyor 79 is arranged in the storage container 14. In an embodiment the conveyor 79 is part of the ice compartment 12*a*. The conveyor 79 can be part of the ice maker 12. By the conveyor 79 the ice form elements stored in the storage container 14 are ejected from the ice maker 12 on demand. They then can be output via the ice chute 11 into the corresponding front side niche in the door 6. The storage container 14 is connected with a front wall 15 of the ice maker 12. The front wall 15 also represents a front wall of an outer housing 16 of the ice maker 12. The outer housing 16 moreover comprises an outer housing wall 17. The outer housing wall 17 is configured to be thermally insulated. The outer housing wall 17 is configured to comprise a vertical wall 17*a* and a bottom wall 17*b* integrally formed therewith. In particular the outer housing wall 17 is configured with an L-shape.

In particular the front wall 15 is configured to be separate from the outer housing wall 17. Preferably the ice maker 12 comprises a front frame 18. The front frame 18 is configured to be separate from the front wall 15. The front frame 18 is connected in particular with the outer housing wall 17. In the mounted state, as shown in FIG. 2, the front wall 15 contacts the front frame 18 directly. The front frame 18 can then also be referred to as front flange. In particular the front wall 15 is pushed, in particular pressed to the front frame 18. Thereby a sealing state is achieved. In particular between the front wall 15 and the front frame 18 a sealing 19 (FIG. 11) is arranged. The sealing 19 is in particular a sealing that is configured to be completely circumferentially extending or almost completely circumferentially extending. It can be arranged on a rear side 20 (FIG. 11) of the front wall 15. The front frame 18 is circumferentially closed. Thereby an opening 18*a* bounded by the front frame 18 is rendered. By this opening 18*a* the storage container 14 is inserted into the outer housing 16 from the front side.

Moreover, the ice maker 12 comprises a driving unit 21. The driving unit 21 is in particular configured to drive the conveyor 79 already mentioned in the above. In particular here a driving by a drive motor is envisaged. Moreover, it may be envisaged that the driving unit 21 is configured for generating an air stream in the ice maker 12. In particular here a cold air stream should be generated. The driving unit 21 is a separate module. The driving unit 21 thus is configured to be separate from the ice producer 13 and separate from the storage container 14. In the embodiment it is arranged at the rear end of the ice maker 12 viewed in the depth direction (z direction). The driving unit 21 comprises a drive housing 22. In the drive housing 22 functional units are arranged. A functional unit of the driving unit 21 can for instance be a fan for generating the air stream. A functional unit, however, can also be for instance a drive motor for driving the conveyor 79. The functional unit, however, for instance can also be an air duct.

Figure 3:
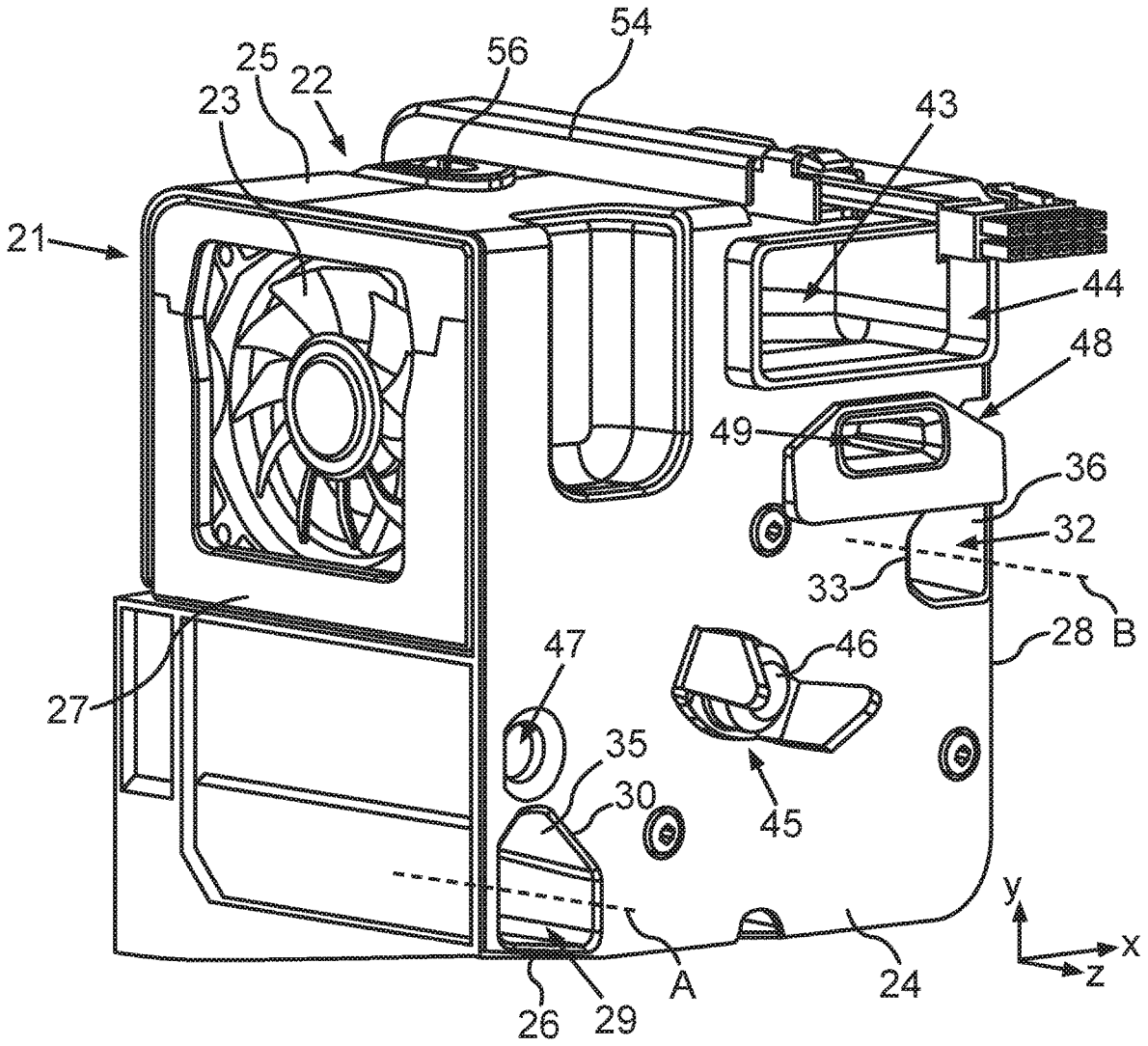
FIG. 3 is a perspective view of an embodiment of a driving unit of an ice maker.

In FIG. 3 in a perspective view the driving unit 21 is shown in an embodiment. Exemplarily, here also a fan 23 is shown, which is arranged in the drive housing 22. The drive housing 22 comprises a front wall 24. Moreover, the drive housing 22 comprises a roof wall 25 as well as a bottom wall 26. Moreover, viewed in the width direction (x-direction), also side walls 27 and 28 are provided. In particular the drive housing 22 forms a cuboid shape. The drive housing 22 with regard to this shape is configured to have a housing wall at each side. Further the roof wall comprises an integrated cable channel 54.

The driving unit 21 comprises a first receiving duct 29. The receiving duct 29 is configured for receiving a first fastening part that is separate thereto to extend completely through the receiving duct 29. The fastening part, which is not shown in FIG. 3, can be a screw or a rivet or a bolt. Also a snapper or a bayonet part for generating a bayonet lock is feasible as fastening part. This fastening part can be inserted from the front through an entry 30 of the receiving duct 29. The receiving duct 29 is formed as a single piece with the drive housing 22. The first fastening part can then be inserted in the first receiving duct 29 in the depth direction towards the back. The first receiving duct 29, as this can be recognized in the front view on the front side 24 in FIG. 4, comprises a rear exit 31. The first receiving duct 29 extends in particular across the entire depth of the drive housing 22. The first receiving duct 29 thus is configured to extend completely through the drive housing 22, wherein this extension is viewed in the depth direction. The exit 31 is equally configured to be open towards the front. Thereby the fastening part can extend towards the rear out of the drive housing 22. By this first receiving duct 29 it is facilitated that the driving unit 21 can be mounted external to the ice maker 12. This means that the driving unit 21 can be fastened to a component of the household cooling appliance 1 that is different to the ice producer 13 and the storage container 14 and the wall 17. By the above-named exemplary fastening parts here a simple non-destructively releasable connection can be achieved. Thereby, a simple mounting concept is facilitated. In particular it is thereby facilitated that a specific module of the ice maker, namely the driving unit 21 itself, can be individually fastened and thus can also be individually fastened at such a component of the household cooling appliance 1. Thereby the most varied individual mounting options and positioning of the driving unit 21 relative to other components of the ice maker 12 are also rendered possible in an improved way. The driving unit 21 can also be referred to as driving unit module or driving unit station.

The first receiving duct 29, as this has already been set out in the above, extends across the entire depth of the drive housing 22. It is configured to be open both at its front end or the entry 30 as well as at its rear end or the exit 31. Moreover the driving unit 21 comprises a second receiving duct 32 (FIG. 3). The second receiving duct 32 is separate and spaced from the first receiving duct 29. In particular also the second receiving duct 32 is integrated in the drive housing 22. It, too, is thus integrally formed therewith. The second receiving duct 32 equally comprises a front side entry 33. It equally extends in the depth direction up to the rear end of the drive housing 22. Also the second receiving duct 32 thus extends across the entire depth of the drive housing 22. As can be recognized in FIG. 4, the second receiving duct 32 comprises a rear exit 34. This exit 34 is open. Thereby, a further fastening part can be provided, which can be inserted through the entry 33 and can project through the exit 34 and the drive housing 22 towards the rear. Also it is thereby facilitated that the driving unit 21 can be fastened to a component that is separate from the driving unit 21. This means that the driving unit 21 can be fastened to a component of the household cooling appliance 1 that is different to the ice producer 13 and the storage container 14 and the wall 17. This component, to which the driving unit 21 is fastened by means of the second fastening part, which is inserted into the second receiving duct 32 and extends through it, is the same component, to which the driving unit 21 can be fastened by the first fastening part, which is inserted into the first receiving duct 31.

As can be recognized in FIG. 3, the first receiving duct 29 is oriented with its longitudinal axis A in the depth direction. The same is true for the second receiving duct 32, which is oriented with its longitudinal axis B in the depth direction. The longitudinal axes A and B are in particular oriented in parallel to each other. In the circumferential direction around the longitudinal axis A the first receiving duct 29 is fully bounded by bounding walls 35. The same is envisaged for the second receiving duct 32. It, too, in the circumferential direction around its longitudinal axis B is fully bounded by bounding walls 36. The receiving ducts 29 and 32 thus are designed to be tunnel-like or tube-like.

Figure 4:
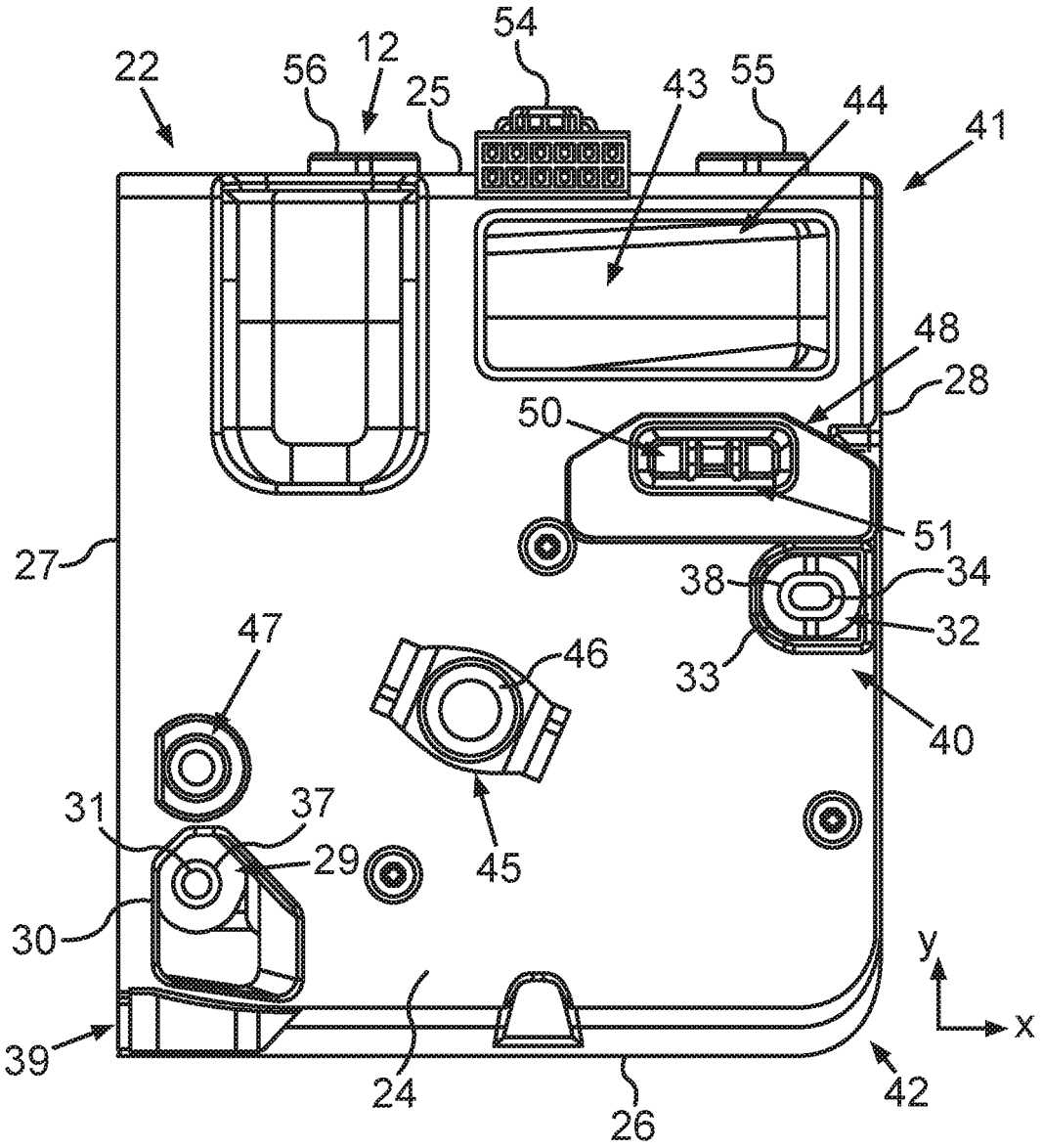
FIG. 4 is a front view of the drive unit according to FIG. 3.

As can be recognized in FIG. 4, the exit 31 is configured to be constricted, in comparison with entry 30. This means that the rear opening or the inner width of the exit 31 is smaller in terms of surface than is the case with the entry 30. In particular it is envisaged that for this purpose a throat 37 or a constriction is configured. Thereby it is achieved that a fastening part with a broadened fastener head can be inserted via the entry 30 into the first receiving duct 29. However, this fastener head is retained to the exit 31. This means that the fastener head cannot be inserted through the exit 31. This is because the exit 31 with its recess hole is dimensioned too small for the fastener head to be capable of being passed through. This is achieved by the throat 37. The throat 37 can for instance also at least in portions be configured to be funnel-like or cone-shaped. Thereby a correspondingly complementarily shaped fastening head can be arranged to be recessed. Thereby the mechanical retention force is increased. Correspondingly, this can be envisaged for the second receiving duct 32. In particular here, too, the exit 34 in comparison with its entry 33 is configured to be constricted. Here, too, correspondingly a throat 38 or constriction can be envisaged. Also this is configured with regard to avoiding a passage or slipping of a fastener head of the further fastening part.

As can be recognized in FIG. 3 and FIG. 4, the two receiving ducts 29 and 32 are arranged offset relative to each other in the height direction (y direction). Additionally or instead, these receiving ducts 29 and 32 are offset relative to each other also in the width direction (x direction). In particular here they are maximally offset relative to each other. The first receiving duct 29 is preferably arranged in a bottom left corner portion 39 of the drive housing 22. This is configured when viewing the front wall 24 from the front side. Preferably the second receiving duct 32 is formed in a lateral edge portion 40 of the drive housing 22. Moreover, in an advantageous embodiment it is configured to be at a distance from a top corner portion 41 and at a distance from a bottom corner portion 42 of the drive housing 22. In particular the second receiving duct 32 is formed approximately half way up the height between the two corner portions 41 and 42.

The first receiving duct 29 comprises a, viewed in the depth direction, rear end portion 29*a* (FIG. 6), as this has already been explained in the above. In the depth direction viewed towards the front, the first receiving duct 29 comprises a front portion 29*b* extending therefrom. This rear end portion 29*a* comprises a constriction so that the rear end portion 29*a* viewed in the cross section perpendicular to the longitudinal axis A is smaller than the front portion 29*b*. This constriction is formed by the throat 37 that has already been explained. This constriction or throat 37 in an advantageous embodiment forms a stop and a passage barrier for a head of the fastening part, as it has already been set out in the above. This fastener head therefore cannot slip through this constriction or this throat 37.

The same is true in analogy for the second receiving duct 32. Here, too, the rear end portion and a front portion extending therefrom in the depth direction towards the front are configured. Here, too, the rear portion has a constriction or narrowing formed by the throat 38. Also thereby the rear end portion is smaller than the front portion viewed in the cross section perpendicular to the longitudinal axis B.

Moreover the driving unit 21 comprises an air duct 43 positioned inside the drive housing 22. From this air duct 43 an air stream L generated by the fan 23 can be guided in the driving unit 21 and thus in the drive housing 22 in a defined way. This air duct 43 of the driving unit 21 comprises an air duct outlet 44. Same is configured in the embodiment in the front wall 24 of the drive housing 22.

In a further advantageous embodiment it is envisaged that on the front wall 24 a passage 45 is formed. Through this passage 45 a shaft 46 of a drive motor 64 shown here (FIG. 7) can extend. The drive motor 64 can be arranged as functional unit in the drive housing 22. A conveyor 79 of the ice maker 12, which conveyor 79 has already been mentioned in the above and by which ice form elements can be conveyed out from the storage container 14, can be coupled by this shaft 46. Thereby the conveyor 79 is set in motion by the drive motor 64. For this purpose the conveyor 79 can comprise a coupling part, which can be coupled in a non-destructively releasable manner to the shaft 46. However, it may also be envisaged that the coupling part extends through the passage 45 into the interior of the drive housing 22 and only in the interior of the housing 22 can couple to a shaft 46 of the drive motor 64.

In a further advantageous embodiment it is envisaged that the driving unit 21 comprises a coupling entry 47 for mechanical coupling of the storage container 14 to the driving unit 21. For instance the storage container 14 can comprise a coupling part at its rear side, which can be inserted into the coupling entry 47. Thereby a mechanical coupling and a position centering of the storage container 14 relative to the driving unit 21 is facilitated. Preferably this coupling entry 47 is configured immediately above the entry 30 of the first receiving duct 29. The coupling entry 47 can be integral part of a mechanical stick connection. However, it may also be integral part of a snap connection. The corresponding counter coupler 80 (FIG. 11), which is arranged at the storage container 14, then forms the respective counterpart for generating the stick connection or the snap connection. The counter coupler 80 can be a coupling pin. The counter coupler 80 is preferably configured to be integrally formed with the storage container 14. In an embodiment the counter coupler 80 is said coupling part.

In a further advantageous embodiment it may be envisaged that the driving unit 21 comprises a closing aid 48. This closing aid 48 can be configured as a separate module of its own. The closing aid 48 allows for the driving unit 21 with the storage container 14 to be held fixed in position. In particular here a self-locking principle is facilitated so that the storage container 14 in the depth direction is led via a certain path independently to the driving unit 21, in particular drawn into the drive housing 22. In an advantageous embodiment it is thereby rendered possible that the front wall 15, which is firmly connected with the storage container 14, equally automatically is drawn in the depth direction towards the rear. Thereby the front wall 15 with a defined pressing force is pressed to the front frame 18 or pulled towards the rear and a corresponding pressing force generated between the named components.

The closing aid 48 comprises an insertion opening 49, as it can be recognized in FIG. 3. This insertion opening 49 is formed in the front wall 24. In an embodiment this insertion opening 49, viewed in the height direction, is configured above the second receiving duct 32. In particular this insertion opening 49, viewed in the height direction, is configured below the air duct outlet 44. Viewed in the width direction, this insertion opening 49, when viewing the front wall 24 from the front side, is configured to be adjacent to the edge portion 40. Thereby, viewed quasi in the height direction, in a sequence from top to bottom the arrangement of the air duct outlet 44, the insertion opening 49, and the entry 33 of the second receiving duct 32 is rendered. Preferably, the insertion opening 49 is arranged in a top half of the height, wherein here the height of the front wall 64 is viewed. The closing aid 48 can be configured as separate module of its own, which is inserted into the drive housing 22.

In FIG. 4 according to the viewing from the front side the closing aid 48 is shown. The insertion opening 49 can be recognized. The closing aid 48 comprises a gripper 50, which can be recognized in the representation in FIG. 4. It is positioned inside the closing aid 48 and thus arranged to be offset towards the rear in the interior of the housing 22. Moreover the closing aid 48 comprises a loaded energy storage 51. The energy storage 51 is arranged in the interior of the 48 and cannot be recognized in the representation shown in FIG. 4. It is therefore only indicated by the corresponding reference sign. By the energy storage 51 a snapping-over of the gripper 50 from a basic position into a snap-over position is achievable, when the loaded energy storage 51 is changed from the loaded state to the unloaded state. This is effected by the fact that in case of an insertion of a coupling extension 52 (FIG. 11), which is arranged on a rear wall 53 (FIG. 11) of the storage container 14 and projects relative to the rear wall 53 towards the rear, into the insertion opening 49 of the coupling extension 52, contacts this gripper 50 in the basic position. By a further pushing of the storage container 14 towards the rear, the gripper 15 is pressed resp. turned towards the rear and thereby the loaded energy storage 51 is actuated. The gripper 50 during this contacting by the coupling extension 52, to start with, performs a rotary movement. The energy storage 51 is then released or then unload and the gripper 50 coupled therewith further performs a translational resp. linear movement towards the rear. By the operating principle the gripper 50 is automatically moved linearly towards the rear by the energy storage 51. By the coupling extension 52 already being coupled to the gripper 50, in the case of this automatic snapping-over of the gripper 50 a pulling along of the coupling extension 52 in the depth direction towards the rear is effected. This is also the automatic dynamic process of the storage container 14 in the depth direction, which is caused by this closing aid 48. The further mechanisms resulting therefrom, as has already been explained in the above, are thereby achieved. In particular this concerns the drawing of the storage container 14 to the front wall 24. In particular, however, this also concerns the sealing pressing of the front wall 15 to the front frame 18. Thus, an independent drawing of the front wall 15 into the locking position is effected. In particular thereby also the storage container 14 is independently drawn into the closed end position towards the rear. In the case of a returning of the gripper 50 to the basic position this is preferably effected by the fact that the front wall 15 with the storage container 14 is pulled in the depth direction towards the front. Thereby the gripper 50, which is coupled with the coupling extension 52, is drawn towards the front. This is a translational movement, which at its end transitions into a rotary movement of the gripper 50. Thereby the gripper 50 then reaches its basic position again. The energy storage 51 is loaded again by this movement of the gripper 50, as it is coupled to the gripper 50. In particular it is thereby pre-stressed. The energy storage 51 can be a spring. However, also a different mechanical energy storage can be provided.

Figure 5:
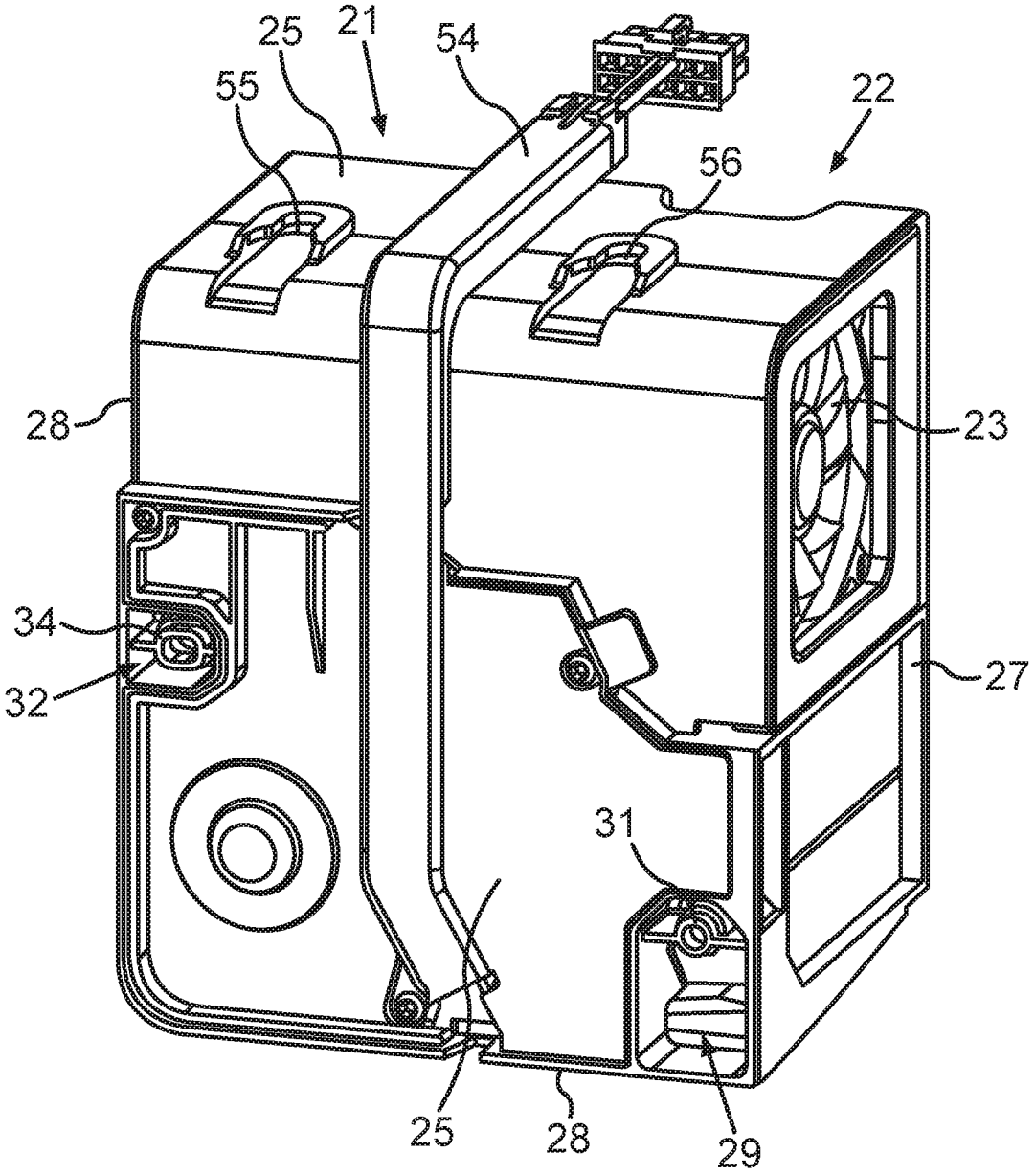
FIG. 5 is a further perspective view of the driving unit according to FIG. 3 and FIG. 4.

In FIG. 5 the driving unit 21 is shown once again as corresponding separate module. In FIG. 5 here the representation of the rear wall 25 of the drive housing 22 is shown. The exits 31 and 34 of the receiving ducts 29 and 32 can be recognized. The correspondingly constricted passages can be recognized.

Thereby in FIG. 5 in a manner corresponding to FIG. 2 and FIG. 3 it can be recognized that in the roof wall 25 of the drive housing 22 coupling entries 55 and/or 56 are formed. These coupling entries 55 and/or 56 can be engaged by counter couplers. Thus, the driving unit 21 can also be fastened to a ceiling wall 57 (FIG. 1) of an inner liner 59 of the household cooling appliance 1. In particular thereby a suspension can be effected. In addition to the non-destructively releasable connections to a rear wall 58 of this inner liner 59 by the fastening parts and the receiving ducts 29 and 32 thus an additional mechanical fastening to the inner liner 59 can be effected. In an embodiment thus the component, to which the driving unit 21 is fastened is the rear wall 58. This is effected by fastening parts, which are horizontally inserted into the receiving ducts 29 and 32. A further component, to which the driving unit 21 can be fastened, is the roof wall 57 of this inner liner 59. The inner liner 59 by its walls bounds the refrigeration compartment 3. In particular it bounds the refrigeration compartment 3 thereby directly.

Figure 6:
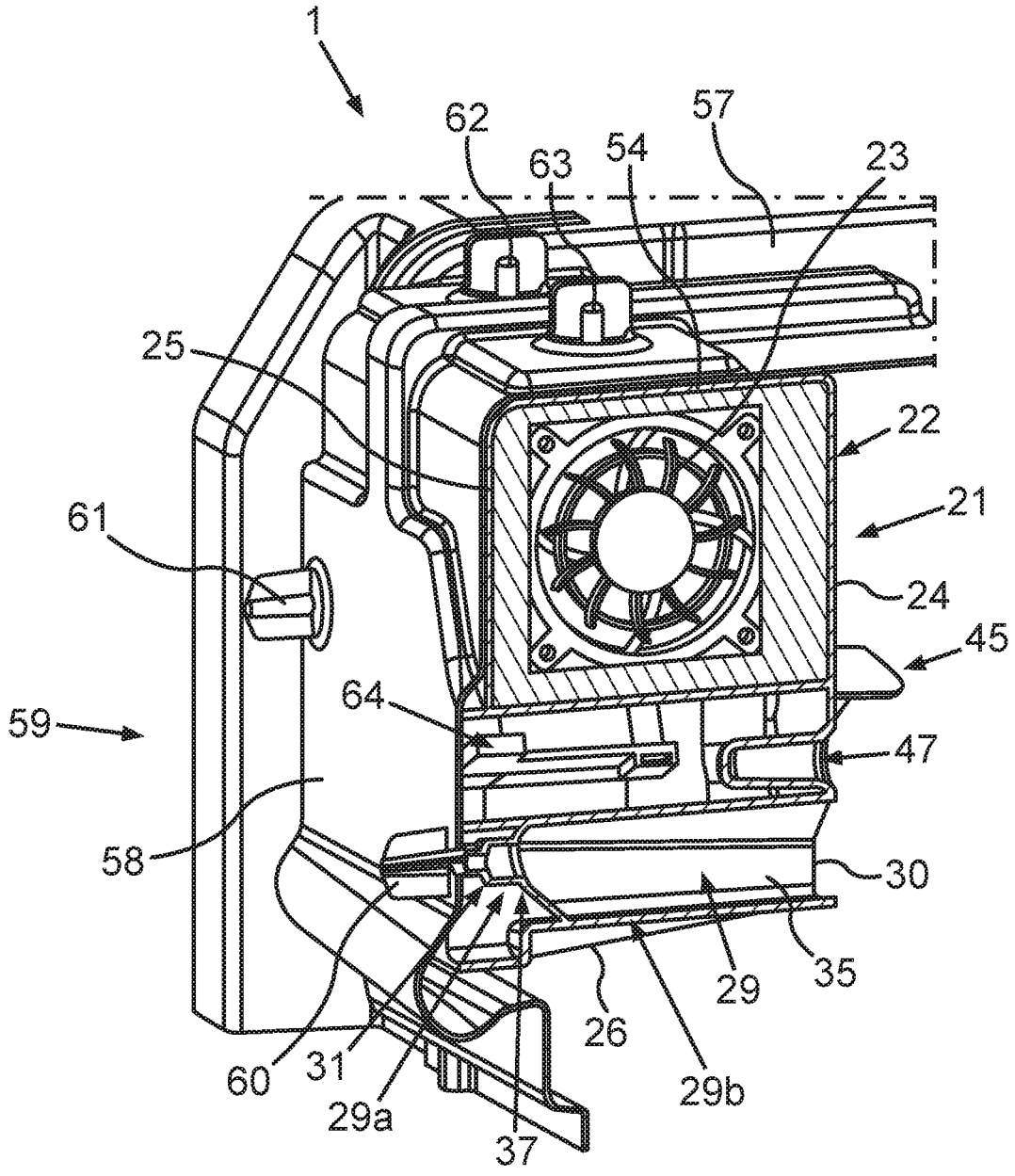
FIG. 6 is a perspective section view of the driving unit according to FIG. 3 to FIG. 5 in the installed state on a wall of an inner liner of the household cooling appliance.

In FIG. 6 in a perspective view a partial portion of the household cooling appliance 1 is shown. Here the inner liner 59 is partially shown. In particular the rear wall 58 and the roof wall 57 is shown. The driving unit 21 is shown in the installed state. In FIG. 6 a perspective sectional view is shown. The sectional plane here is drawn through the first receiving duct 29. As can be recognized, at an outer side of the rear wall 58 a reinforcement part 60 is arranged. This comprises a receiving portion, into which the fastening part (not shown) can be inserted. In particular this may for instance be a screw boss, into which a screw representing a fastening part can be screwed. Equally, this, however, can also be for instance a bolt duct or a rivet duct. Also a socket for a snap connection can be configured in the reinforcement part 60. A further reinforcement part 61 can be recognized. Same is arranged in the portion at the rear side of the rear wall 58, on which the exit 34 of the second receiving duct 32 is arranged. Moreover corresponding couplers 62 and 63 are shown as reinforcement parts that are arranged at the outer side of the roof wall 57 of the inner liner 59. Therein the corresponding options for coupling to the coupling entries 55 and 56 are facilitated. In the inserted state of a first fastening part into the first receiving duct 29 a head of a fastening part contacts the entry of the constriction or the throat 37 and extends towards the rear through the constricted rear end portion 29*a* of the first receiving duct 29 through the rear wall 58 into the reinforcement part 60. Accordingly, the second fastening part is arranged in the second receiving duct 32 and extends accordingly into the further reinforcement part 61.

For mounting, as this can be recognized in FIG. 6, a separate fastening part is pushed through via the front side of the ice compartment 12*a* or the ice maker 12, in particular through the front frame 18, and inserted into the first receiving duct 29. The module with the front wall 15 and the storage container 14 in this mounting state is not yet present. This first fastening part is then pushed within the receiving duct 29 far enough towards the rear to reach through the rear wall 58 and to be inserted into the reinforcement part 60. It is then correspondingly fastened so that a stable holding of the driving unit 12 is reached. The same is performed before or after with a second fastening part, which in an advantageous way is equally inserted through the front frame 18 in the depth direction and then introduced into the second receiving duct 32, is passed through the rear wall 58 and inserted into the reinforcement part 61.

Figure 7:
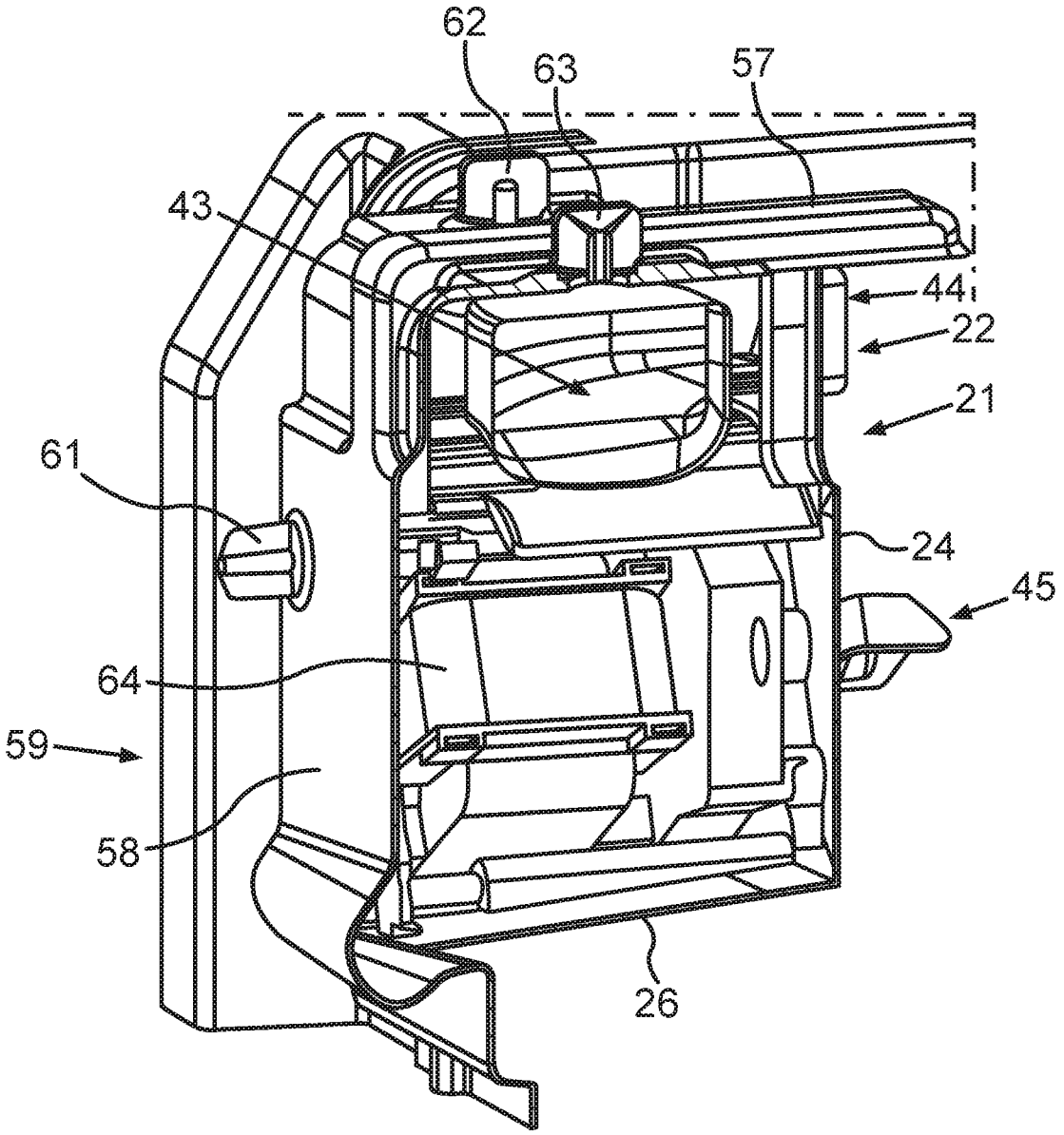
FIG. 7 is a perspective sectional view of the arrangement according to FIG. 6 in a sectional plane that is different therefrom.

In FIG. 7 a representation according to FIG. 6 is shown, with the sectional plane, however, being shown in a different way than in FIG. 6 partly through a coupler 63. The drive motor 64 can be recognized equally as in FIG. 6.

Figure 8:
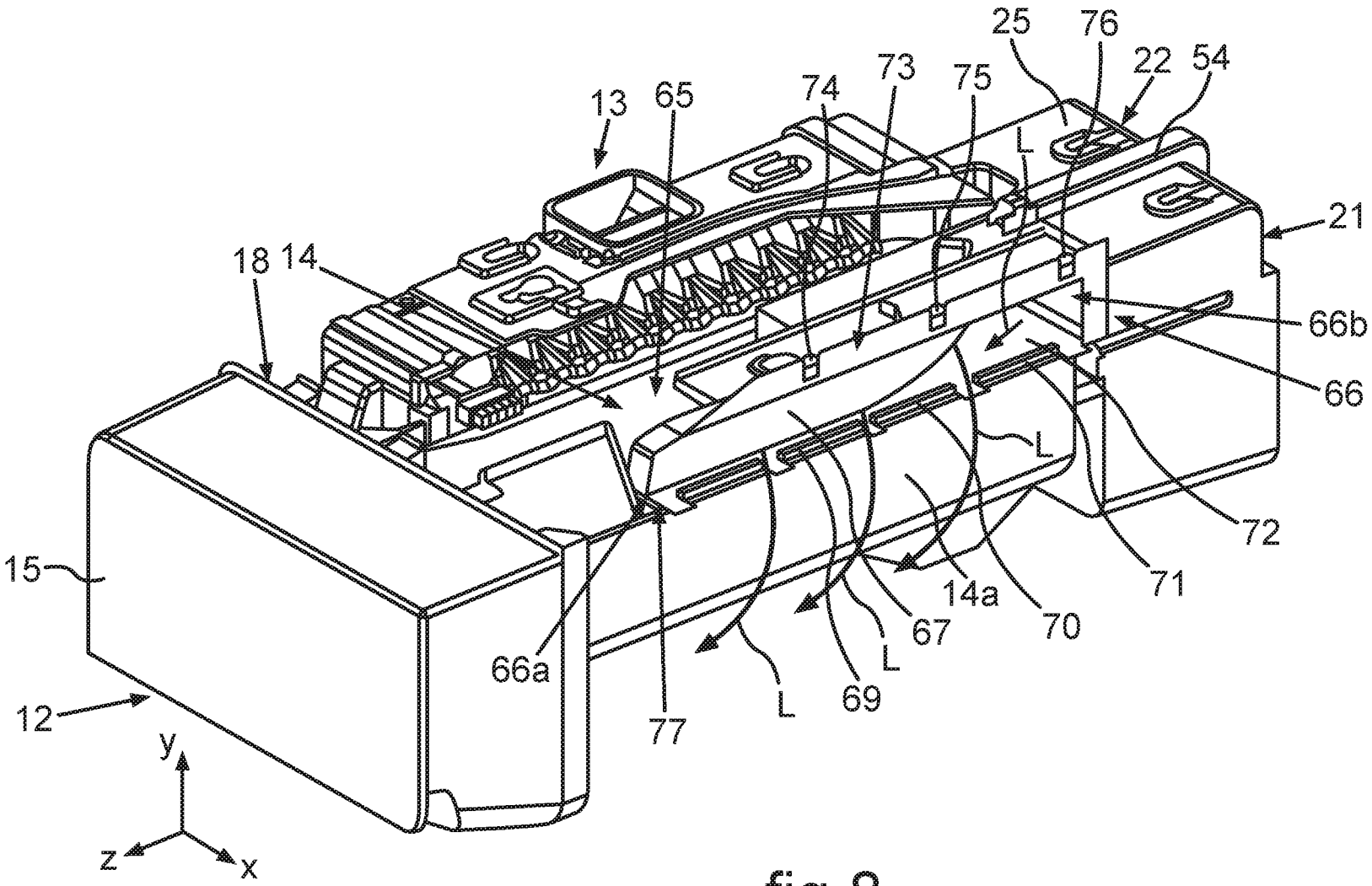
FIG. 8 is a perspective view of the ice maker with removed housing wall of an outer housing.

In FIG. 8 in a further perspective view the ice maker 12 is shown. The storage container 14 comprises an opening 65. The opening 65 is directed upward so that the storage container 14 is accessible from the top via this opening 65. The storage container 14 moreover has an outer side 14*a*. This is the outer side 14*a* of the walls of the storage container, which bound the volume of the storage container 14. The walls of the storage container 14 are a first side wall, a bottom wall that is adjacent to first side wall, and a second side wall that is adjacent to the bottom wall. The bottom wall is positioned opposite the opening 65, when viewed in the height direction. The storage container 14, viewed in a cross section perpendicular to the depth direction, is configured to be U-shaped.

The ice maker 12 moreover comprises an air guiding duct 66. The air guiding duct 66 comprises a first lateral duct wall 67. This first lateral duct wall 67 extends in the depth direction of the ice maker 12 and extends in the height direction of the ice maker 12. The air guiding duct 66 moreover is bounded by a second duct wall 68. The second duct wall 68 is a roof wall. The air guiding duct 66 comprises at least one opening 69, which is open towards the bottom. In particular in an embodiment three such openings 69, 70, and 71 are configured. All of these are configured to be open towards the bottom. An air stream L flowing through the air guiding duct 66 by the geometry of the duct walls and their arrangement relative to each other is released from the air guiding duct 66 towards the bottom. This is effected by the openings 69, 70, and 71.

The air guiding duct 66, viewed in the width direction of the ice maker 12, is arranged offset relative to the opening 65 of the storage container 14. In particular this offset arrangement is such that the air stream L exiting from the first opening 69, 70, 71 of the air guiding duct 66 flows around the storage container 14 at its outer side 14*a*. In particular the arrangement of the first openings 69, 70, and 71 to the storage container 14, in particular its opening 65 toward the top, is such that no overlapping in the width direction is given. The exiting of the air stream L from the openings 69, 70, 71 thereby is not effected via the opening 65 into the storage container 14. The air stream L thus only flows around the storage container 14 at its outer side 14*a*.

In particular the air guiding duct 66 comprises a bottom wall 72. In this bottom wall 72 the first openings 69, 70, 71 are formed. Through the bottom wall 72 the opening 65 of the air guiding duct 66 is also covered in the portion, in which it overlaps in the width direction with the opening 65. Thereby no air stream flows through the opening 65 into the storage container 14. In particular by the first lateral duct wall 67 and the second duct wall 68 showing the roof wall the air stream L is conducted into the air conduction duct in the depth direction of the ice maker 12. The first lateral duct wall 67, the second duct wall 68, and in particular the bottom wall 72 are integrally formed with each other as a single piece. In particular a component 77 is thereby formed, in particular from plastic. The first lateral duct wall 67 is configured to be uneven. It is curved in an arch-shaped manner. In particular at the rear end facing the driving unit 62, in particular a rear half, an arch-shaped curvature is configured. A curvature is provided only in one direction. In particular the curvature is directed towards the ice producer 13.

Preferably the air guiding duct 66 comprises a second lateral duct wall bounding the air guiding duct 66 at the side opposite the first lateral duct wall 67. In particular this second lateral duct wall is formed by an outer housing wall of the outer housing 16 of the ice maker 12. The outer housing wall is in particular formed by the wall 17*a*, as it is shown in FIG. 2. This wall 17*a*, however, is a wall that is separate from the walls 67, 68, and 72. In the assembled state the component 77 with the walls 67, 68, and 72, viewed in the width direction, directly contacts the inner side of the outer housing wall 17*a*.

As can be recognized moreover in FIG. 8, the component 77 with the integrally formed walls 67, 68, and 72 comprises a flange 73. This flange 73 is in particular L-shaped. It is envisaged for contacting the inner side of the outer housing wall 17*a*. In an advantageous embodiment in this flange 73 resilient parts 74, 75, and 76 are configured to be integrally formed with each other as a single piece. Thereby in the mounted state a pressing of this 77 to the outer housing wall 17*a* is achieved.

Figure 9:
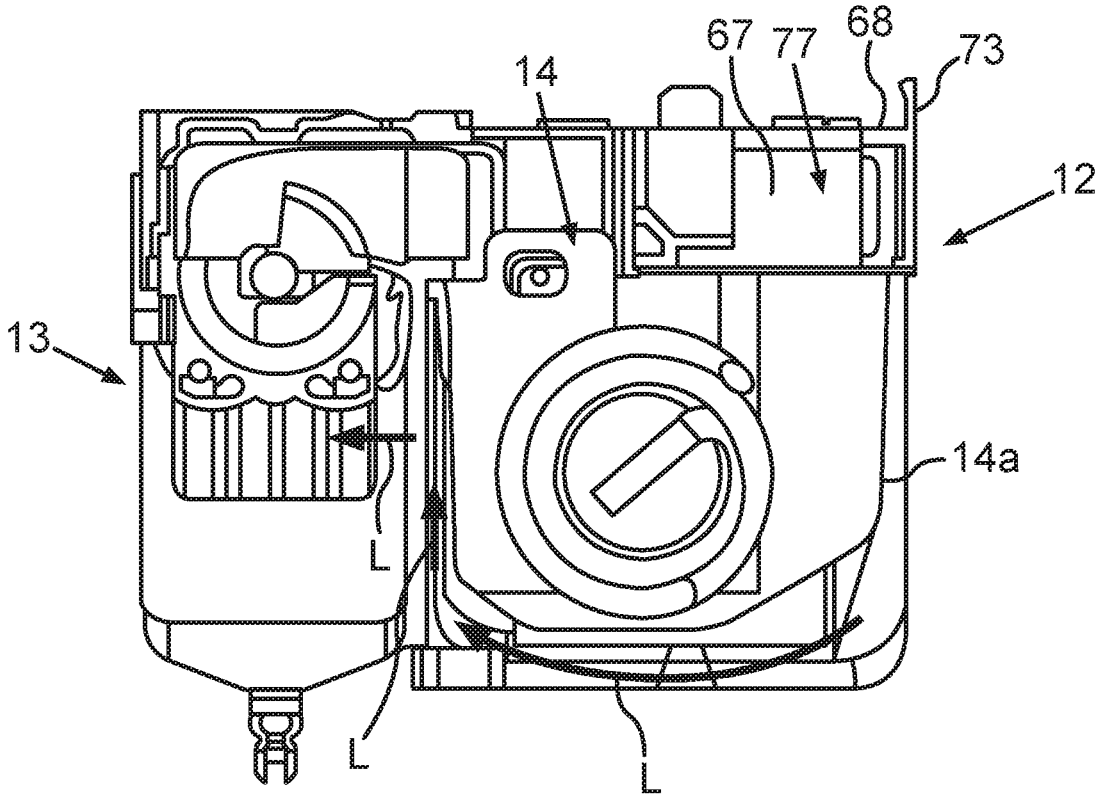
FIG. 9 is a vertical sectional view of the embodiment according to FIG. 8.

The component 77, which is formed as a single piece and comprises the walls 67, 68, and 72 as well as the flange 73, is arranged in non-destructively releasable manner at the driving unit 21. For this purpose the driving unit 21 comprises a coupler oriented in the depth direction towards the front. This component is fitted upon this coupler. This component 77 in FIG. 9 is shown in the sectional view, as is the storage container 14 and the ice producer 13. The progression of the air stream L is shown in FIG. 9. It can be recognized that this fully flows around the storage container 14 at its outer side 14*a* and then enters the ice producer 13.

The air guiding duct 66, viewed in the depth direction, comprises a front end 66*a* and a rear end 66*b*. The air guiding duct 66 narrows, in particular continuously, starting from the rear end 66*b* towards the front up to the front end 66*a*. Thereby a pressing of the airstream L outward out of the openings 69, 70, 71 is supported.

Figure 10:
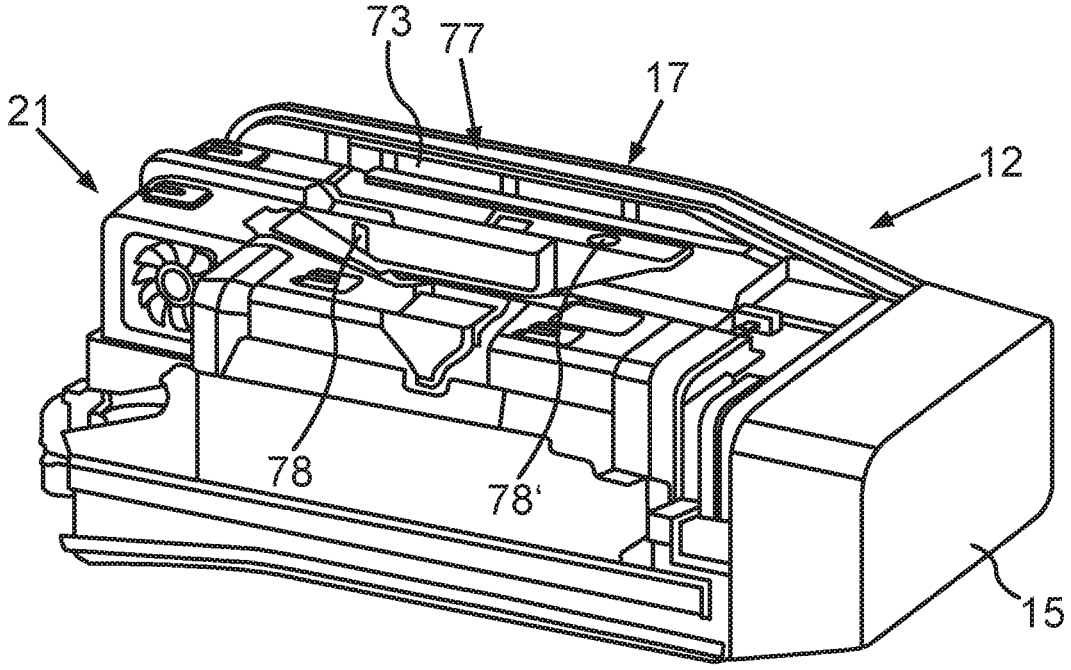
FIG. 10 is a further perspective view of an embodiment of an ice maker.

In FIG. 10 in a further perspective view the ice maker 12 is shown. The component 77 moreover comprises further openings 78, from which the air stream L can exit towards the top. Thereby additionally an air stream can directly reach the ice producer 13. A further opening 78' corresponding with fixation element on the ceiling of the ice compartment 12*a* for mounting of the air guiding duct 66 to the ice compartment 12*a*. The ceiling of the ice compartment 12*a* is a portion of the inner liner of the refrigeration compartment 3.

Figure 11:
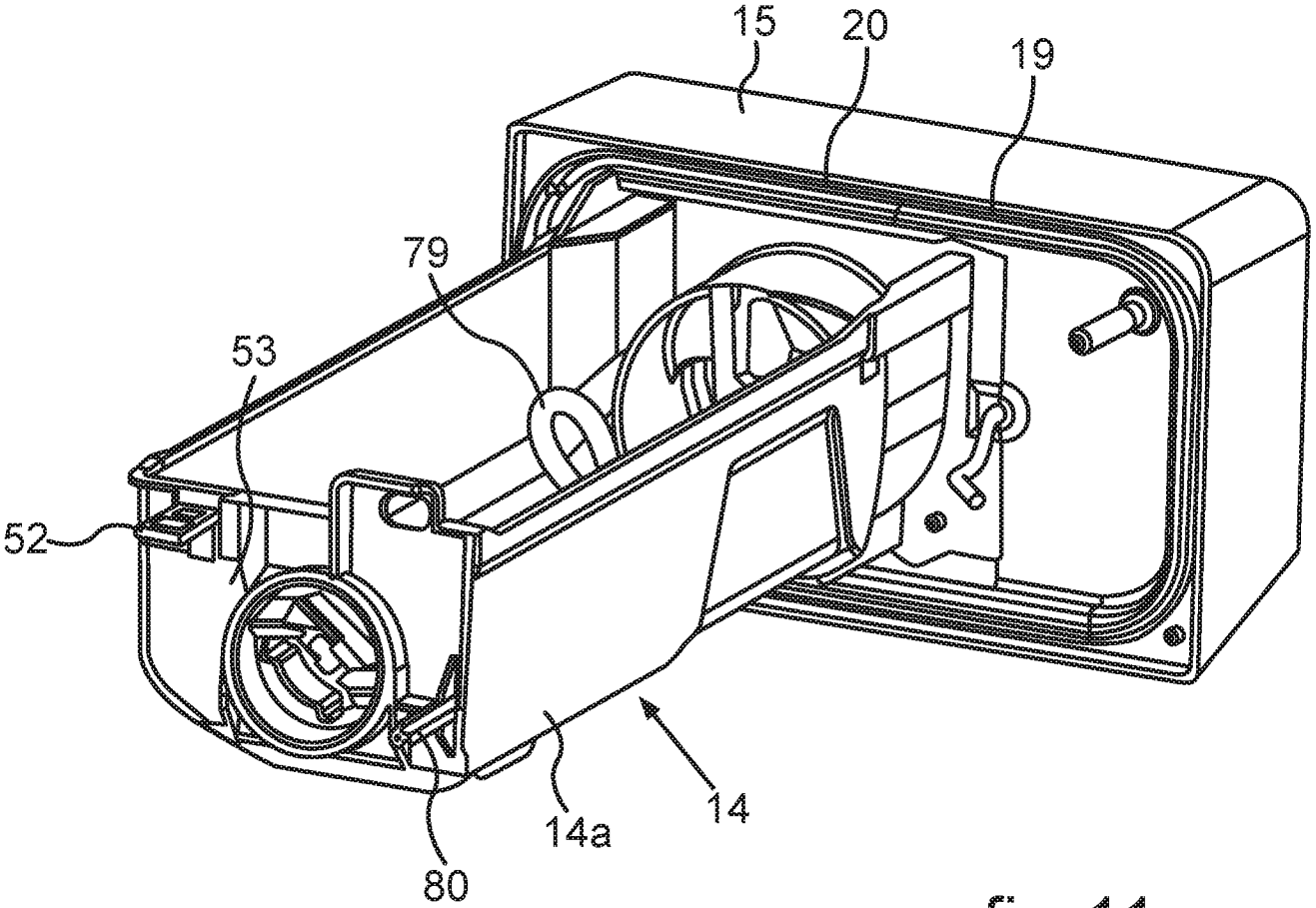
FIG. 11 is a perspective view of partial components of the ice maker.

In FIG. 11 in a perspective view the module with the front wall 15 and the storage container 14 is shown. Here also the storage container 14 is shown. Also the conveyor 79 is arranged here in the storage container 14. The coupling extension 52 is configured in particular as loop. It thus comprises a frame bounding a recess. This recess is engaged by the gripper 50.

Figure 12:
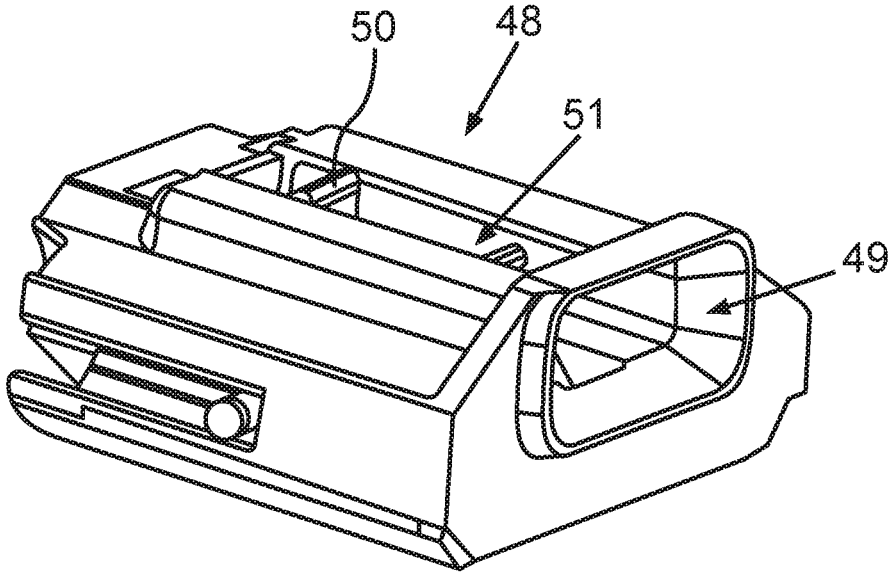
FIG. 12 is a perspective view of a closing aid.

In FIG. 12 in a perspective view the closing aid 48 is shown. The coupling extension 52 is inserted via the insertion opening 49 and then couples to the gripper 50.

In an embodiment, the first receiving duct and the second receiving duct viewed in the width direction of the driving unit are arranged offset relative to each other.

In an embodiment, by the air stream exiting from the opening of the air guiding duct an outer side of a first side wall of the storage container and an outer side of a bottom wall of the storage container and an outer side of a second side wall of the storage wall are flown, wherein said bottom wall is opposite to the opening of the storage container, which is accessible from the top.

In an embodiment, at least by the first lateral duct wall and the roof wall the air stream in the air guiding duct is guided in the depth direction of the ice maker.

In an embodiment, the first lateral duct wall and the roof wall are configured as single-piece duct part.

In an embodiment, the first lateral duct wall at least in portions is curved in arch-like manner.

In an embodiment, the first lateral duct wall viewed in the depth direction in a rear half of its length is curved towards the interior of the ice maker.

In an embodiment, the air guiding duct comprises a second lateral duct wall, which bounds the air guiding duct at the side opposite the first lateral duct wall.

In an embodiment, the ice maker comprises an outer housing wall, which is the second lateral duct wall.

In an embodiment, the roof wall comprises a contact flange, which directly contacts the second lateral duct wall.

In an embodiment, the air guiding duct comprises a rear end and an opposite front end, and the air guiding duct is narrowed from the rear end towards the front end.

In an embodiment, the ice maker comprises a driving unit, which comprises a housing and a fan arranged therein, wherein the air stream can be generated by the fan, wherein the air guiding duct is connected with a rear end to the housing.

In an embodiment, the air guiding duct is arranged at the driving unit by a stick connection.

In an embodiment, the air guiding duct in the width direction of the ice maker is arranged to overlap in portions in an overlapping area with the opening of the storage container, wherein the air guiding duct comprises a bottom wall, by which the opening of the storage container is covered from the top in the overlapping area.

In an embodiment, the first opening of the air guiding duct is formed in the bottom wall, and in the width direction is arranged external to the overlapping area.

In an embodiment, said ice maker is arranged in a refrigeration compartment of a household cooling appliance.

The following is a list of reference numerals used in the above description of the invention with reference to the drawing figures:

| | |
|---|---|
| 1 | household cooling appliance |
| 2 | outer housing |
| 3 | refrigeration compartment |
| 4 | freezer compartment |
| 5 | door |
| 6 | door |
| 7 | door |

-continued

| | |
|---|---|
| 8 | module |
| 9 | output |
| 10 | dispenser |
| 11 | ice chute |
| 12 | ice maker |
| 12a | ice compartment |
| 13 | ice producer |
| 14 | storage container |
| 14a | outer side |
| 15 | front wall |
| 16 | outer housing |
| 17 | outer housing wall |
| 17a | vertical wall |
| 17b | bottom wall |
| 18 | front frame |
| 18a | opening |
| 19 | seal |
| 20 | rear side |
| 21 | driving unit |
| 22 | drive housing |
| 23 | fan |
| 24 | front wall |
| 25 | roof wall |
| 26 | bottom wall |
| 27 | side wall |
| 28 | side wall |
| 29 | receiving duct |
| 29a | rear end portion |
| 29b | front portion |
| 30 | entry |
| 31 | exit |
| 32 | receiving duct |
| 33 | entry |
| 34 | exit |
| 35 | bounding walls |
| 36 | bounding walls |
| 37 | throat |
| 38 | throat |
| 39 | corner portion |
| 40 | edge portion |
| 41 | corner portion |
| 42 | corner portion |
| 43 | air duct |
| 44 | air duct outlet |
| 45 | passage |
| 46 | shaft |
| 47 | coupling entry |
| 48 | closing aid |
| 49 | insertion opening |
| 50 | gripper |
| 51 | energy storage |
| 52 | coupling extension |
| 53 | rear wall |
| 54 | cable channel |
| 55 | coupling entry |
| 56 | coupling entry |
| 57 | ceiling wall |
| 58 | rear wall |
| 59 | inner liner |
| 60 | reinforcement part |
| 61 | reinforcement part |
| 62 | coupling element |
| 63 | coupling element |
| 64 | drive motor |
| 65 | opening |
| 66 | air guiding duct |
| 66a | front end |
| 66b | rear end |
| 67 | duct wall |
| 68 | duct wall |
| 69 | opening |
| 70 | opening |
| 71 | opening |
| 72 | bottom wall |
| 73 | flange |
| 74 | part |
| 75 | part |
| 76 | part |
| 77 | component |

-continued

| | |
|---|---|
| 78 | opening |
| 78' | opening |
| 79 | conveyor |
| 80 | counter coupler |
| A | longitudinal axis |
| B | longitudinal axis |
| L | air stream |

The invention claimed is:

1. An ice maker for mounting into a household cooling appliance, the ice maker comprising:

a storage container for ice, said storage container having an outer side and an opening accessible from above;

a fan for generating an air stream in the ice maker;

an air guiding duct disposed above said storage container in a height direction of the ice maker, said air guiding duct being bounded by a first lateral duct wall that is oriented in the depth direction of the ice maker and extends in the height direction, and said air guiding duct being bounded by a second duct wall, being a roof wall, and at least said first lateral duct wall and said roof wall being configured to guide the air stream in said air guiding duct in the depth direction of the ice maker;

said air guiding duct having at least one first opening that is open towards a bottom of said storage container to enable an air stream streaming in the air guiding duct to escape towards the bottom of said storage container from said air guiding duct, wherein said at least one first opening of said air guiding duct is offset in a width direction of the ice maker so that the air stream exiting from said at least one first opening of said air guiding duct flows along said storage container on the outer side.

2. The ice maker according to claim 1, wherein the air stream exiting from said opening of said air guiding duct flows along an outer side of a first side wall of said storage container and an outer side of a bottom wall of said storage container and an outer side of a second side wall of said storage wall, wherein said bottom wall is opposite said opening of said storage container that is accessible from above.

3. The ice maker according to claim 1, wherein said first lateral duct wall and said roof wall are a single-piece duct part.

4. The ice maker according to claim 1, wherein said first lateral duct wall is curved, at least in portions thereof, in an arch shape.

5. The ice maker according to claim 4, wherein said first lateral duct wall, viewed in the depth direction, is curved in a rear half of a length thereof towards the interior of the ice maker.

6. The ice maker according to claim 1, wherein said air guiding duct comprises a second lateral duct wall, which bounds said air guiding duct at a side opposite said first lateral duct wall.

7. The ice maker according to claim 6, further comprising an outer housing wall forming said second lateral duct wall.

8. The ice maker according to claim 7, wherein said roof wall comprises a contact flange in direct contact with said second lateral duct wall.

9. The ice maker according to claim 1, wherein said air guiding duct comprises a rear end and an opposite front end, and said air guiding duct is narrowed from the rear end towards the front end.

10. The ice maker according to claim 1, further comprising a driving unit, which includes a housing and said fan being arranged in said housing and configured to generate the air stream, wherein said air guiding duct is connected with a rear end to said housing.

11. The ice maker according to claim 10, wherein said air guiding duct is arranged at said driving unit by a stick connection.

12. The ice maker according to claim 1, wherein said air guiding duct, in the width direction of the ice maker, is arranged to overlap in portions in an overlapping area with said opening of said storage container, wherein said air guiding duct includes a bottom wall, by which the opening of the storage container is covered from the top in the overlapping area.

13. The ice maker according to claim 12, wherein said at least one first opening of said air guiding duct is formed in said bottom wall, and in the width direction is arranged external to the overlapping area.

14. The ice maker according to claim 1, configured for placement in a refrigeration compartment of the household cooling appliance.

15. A household cooling appliance, comprising:

an ice maker, said ice maker having:

a storage container for ice, said storage container having an outer side and an opening accessible from above;

a fan generating an air stream in the ice maker, an air guiding duct disposed above said storage container in a height direction of the ice maker, said air guiding duct being bounded by a first lateral duct wall that is oriented in the depth direction of the ice maker and extends in the height direction, and said air guiding duct being bounded by a second duct wall, being a roof wall, and at least said first lateral duct wall and said roof wall are configured to guide the air stream in said air guiding duct in the depth direction of the ice maker;

said air guiding duct having at least one first opening that is open towards a bottom of said storage container to enable an air stream streaming in the air guiding duct to escape towards the bottom of said storage container from said air guiding duct, wherein said at least one first opening of said air guiding duct is offset in a width direction of the ice maker so that the air stream exiting from said at least one first opening of said air guiding duct flows along said storage container on the outer side.

* * * * *